US005535788A

United States Patent [19]

Mori et al.

[11] Patent Number: 5,535,788

[45] Date of Patent: Jul. 16, 1996

[54] WIRE HARNESS HOLDING DEVICE, AND WIRE HARNESS HOLDING MECHANISM AND METHOD USING THE WIRE HARNESS HOLDING DEVICE

[75] Inventors: Masaharu Mori; Terumi Inagaki, both of Yokkaichi, Japan

[73] Assignee: Sumitomo Wiring Systems, Ltd., Mie, Japan

[21] Appl. No.: 332,059

[22] Filed: Nov. 1, 1994

[30] Foreign Application Priority Data

Nov. 4, 1993 [JP] Japan ..... 5-275561

[51] Int. Cl.[6] ..... B21F 27/12

[52] U.S. Cl. ..... 140/92.1; 29/755

[58] Field of Search ..... 140/92.1, 93 R; 29/748, 755; 269/216, 287, 903

[56] References Cited

U.S. PATENT DOCUMENTS 2,768,428 10/1956 MacGregor et al. ..... 140/92.1
3,264,860 8/1966 Herb ..... 29/748
5,168,904 12/1992 Quinkert ..... 140/92.1

FOREIGN PATENT DOCUMENTS 4-99313 8/1992 Japan .

*Primary Examiner*—Lowell A. Larson
*Attorney, Agent, or Firm*—Beveridge, DeGrandi, Weilacher & Young

[57] ABSTRACT

According to one mode of the present invention, a wire harness holding device is disclosed. The wire harness holding device has an electric wire holding portion for holding a predetermined portion of a wire harness; an opening/closing member attached to the electric wire holding portion; and a drive unit for driving the opening/closing member to one of the positions at a predetermined timing. The opening/closing member is movable between the surrounding position where the opening/closing member locks up a wire harness in the electric wire holding portion, and the release position where the opening/closing member releases the wire harness from the electric wire holding portion. Unless the drive unit is operated, the opening/closing member is maintained at the release position or the surrounding position.

10 Claims, 9 Drawing Sheets

WIRE HARNESS HOLDING DEVICE, AND WIRE HARNESS HOLDING MECHANISM AND METHOD USING THE WIRE HARNESS HOLDING DEVICE

TECHNICAL FIELD OF THE INVENTION

The present invention relates to a wire harness holding device, and wire harness holding mechanism and method for using the wire harness holding device above-mentioned, and more particularly to a wire harness holding device best suited for production of a wire harness to be installed on a drawing plate or the like, and to wire harness holding mechanism and method using such a wire harness holding device.

RELATED BACKGROUND ART

A wire harness is an electric wiring system comprising a large number of electric wires, terminals, connectors and the like to be incorporated in a motor vehicle, a copying apparatus or the like.

Since it is difficult to specify the form, such a wire harness is generally laid out on a working table called a drawing plate to shape the final form thereof, and then connected, on the drawing plate, to externally mounted parts such as protectors, grommets and the like (See, for example, Japanese Utility Model Laid-Open Publication No. 4-99313).

To hold the wire harness on the drawing plate, a large number of jigs are fixed on the drawing plate. Each of these jigs is usually made of a metallic member having a substantially U-shape section of which the top is opened.

Also disposed on the drawing plate are jigs incorporating detecting switches for detecting externally mounted parts. The detecting switches are electrically connected to a controller. Each detecting switch is adapted to transmit a detection signal to the controller when the detecting switch detects an externally mounted part to be assembled in the production process. When all the detecting switches have transmitted the detection signals to the controller, the controller not only actuates an informing mechanism such as an acceptance buzzer, a pilot lamp or the like, but also actuates an acceptance stamp sealing machine. The acceptance stamp sealing machine is adapted to seal an acceptance stamp on a product number label. The operator can be aware of the fact that the process has been finished upon actuation of the informing mechanism. Further, the operator can visually make sure that the assembly acceptance stamp has securely been sealed.

The completed wire is then subjected to an inspection process including an electrical conduction inspection, an appearance inspection and the like. Conventionally, once a wire harness was removed from the drawing plate for production and then placed on another drawing plate for inspection in order to carry out above mentioned inspection process. However, such an inspection process may recently be carried out upon while the wire harness is on the same drawing plate as that used in the production process.

To conduct an electrical conduction inspection in the inspection process, an electrical conduction testing device is placed on the drawing plate. The conduction testing device is electrically connected to conduction inspecting jigs for judging whether or not the electrical conduction of connector housings, terminals and the like of a wire harness is good.

When inspection signals are transmitted from all the conduction inspecting jigs to the conduction testing device, the conduction testing device judges that the conduction of the wire harness is good. Then, the conduction testing device actuates the informing mechanism incorporated therein to inform the operator of the judging result, and also actuates the acceptance stamp sealing machine such that an inspection acceptance stamp is sealed. Thus, the operator can be aware of the fact that the process has been finished upon actuation of the informing mechanism, and then visually makes sure that the inspection acceptance stamp has securely been sealed.

Such processes of producing and inspecting a wire harness on a drawing plate present the following problems.

First, the following problems are encountered in the production process.

The wire harness is merely carried by the substantially U-shape metallic jigs. Accordingly, the wire harness is liable to come off from the jigs during the production process, thus lowering the working efficiency. That is, when attaching parts to the wire harness, it is required to attach such parts while force is applied to the wire harness or while a portion of the wire harness is carried under an arm of the operator.

Often, the informing mechanism for informing the completion of the production process, is the same as that used in the other production line. Accordingly, there have been instances where an unfinished wire harness has erroneously been removed from the drawing plate due to a mistake of the operator or when the operators are changed in the middle course of the work.

In view of the foregoing, the present invention is proposed with the object of providing a wire harness holding device and wire harness holding mechanism and method using this wire harness holding device capable of not only preventing a wire harness from unduly coming off from jigs, but also preventing defective products from being sent to subsequent steps.

In the inspection process, visual examination is exclusively carried out in order to judge whether or not the inspection acceptance stamp has securely been sealed, or whether or not the electrical conduction test has successfully been finished. This involves the likelihood, as a consequence of human factors, that there remain some parts not inspected yet or a wire harness presenting a defective sealing is removed from the drawing plate.

For the foregoing reasons, there is a need for a wire harness holding device and wire harness holding mechanism and method using the wire harness holding device above-mentioned capable of securely preventing an unfinished product from being removed as a consequence of human factors.

DISCLOSURE OF THE INVENTION

The present invention is directed to a wire harness holding device, and to wire harness holding mechanism and method using the wire harness holding device above-mentioned, that satisfy this need. The wire harness holding device comprises: an electric wire holding portion for holding a predetermined portion of a wire harness; an opening/closing member attached to the holding portion; and a drive unit for driving the opening/closing member to one of its positions at a predetermined timing. The opening/closing member is movable between the surrounding position where the opening/closing member locks up a wire harness in the electric wire holding portion, and the release position where the opening/closing member releases the wire harness from the electric wire holding portion. According to the present invention, when located in the release position, the opening/closing member opens the electric wire holding portion, enabling a wire harness to be introduced into the electric wire holding portion. When located in the surrounding position, the opening/closing member can surrounds a wire harness together with the electric wire holding portion. Since the drive unit is used for driving the opening/closing member to one of the positions at a predetermined timing, the opening/closing member is maintained at the release position or the surrounding position unless the drive unit is operated. Thus, a wire harness is surrounded by the electric wire holding portion in association with the opening/closing member to be controlled by the drive unit. Further, unless the drive unit is operated, the opening/closing member is not displaced. Accordingly, even though parts are attached to a wire harness with the use of U-shape jigs placed on a drawing plate, the wire harness is advantageously prevented from unduly coming off from the jigs.

According to a preferable mode, the drive unit is adapted to drive the opening/closing member in such a way that the opening/closing member is driven to the surrounding position when the wire harness is mounted on the electric wire holding portion in the course of a predetermined process, and that the opening/closing member at the surrounding position is driven to the release position based on a process completion signal to be supplied upon completion of the predetermined process. Accordingly, the present invention presents the advantage to prevent a wire harness from being unduly removed from the drawing plate as a consequence of human factors before the predetermined process is finished. Further, when executing a plurality of processes, the opening/closing member can be maintained at the surrounding position until the final process is finished. Accordingly, even though a plurality of processes are carried out on the same drawing plate, the wire harness can be prevented from being unduly removed as a consequence of human factors from the drawing plate in the middle course of the processes.

According to a further preferable mode, the drive unit comprises: an electromagnetic solenoid for driving the opening/closing member to one of the positions; a locking cam for locking the opening/closing member driven to one of the positions by the electromagnetic solenoid; and a biasing member for biasing the opening/closing member to the other of the positions. Even after the energization of the electromagnetic solenoid is stopped, the opening/closing member can be maintained at either the surrounding position or the release position by the locking mechanism. Accordingly, when an electromagnetic solenoid is used as the drive unit, the solenoid needs not to be energized for a long period of time, thus preventing seizing or the like.

According to another aspect, the present invention provides a wire harness holding mechanism where the holding device above-mentioned is mounted on a movable drawing plate adapted to be moved by one process area per process. In this wire harness holding mechanism, the drive unit of the holding device is adapted to drive the opening/closing member to the surrounding position in association with the movement of the movable drawing plate. According to this arrangement, the drive unit is automatically operated according to the movement of the movable drawing plate, thereby to move the opening/closing member to the surrounding position, enabling the wire harness to be held. This improves the working efficiency. Further, after the drive unit has been operated, the wire harness can advantageously be prevented from unduly coming off or erroneously removed as a consequence of human factors in the moving course of the drawing plate.

According to a further aspect, the present invention provides a wire harness holding method comprising the steps of: holding a bundle of electric wires forming a wire harness on a drawing plate; carrying out a processing step of executing a predetermined process on the bundle of electric wires thus held; and releasing the bundle of electric wires based on a process completion signal after said processing step has been finished. Unless the process completion signal is supplied, the wire harness remains secured onto the drawing plate. This prevents the wire harness from unduly coming off from jigs.

BRIEF DESCRIPTION OF THE DRAWINGS

By way of example only, specific embodiments of the present invention will now be described with reference to the accompanying drawings, in which.

DESCRIPTION OF THE PREFERRED EMBODIMENTS

Figure 1:
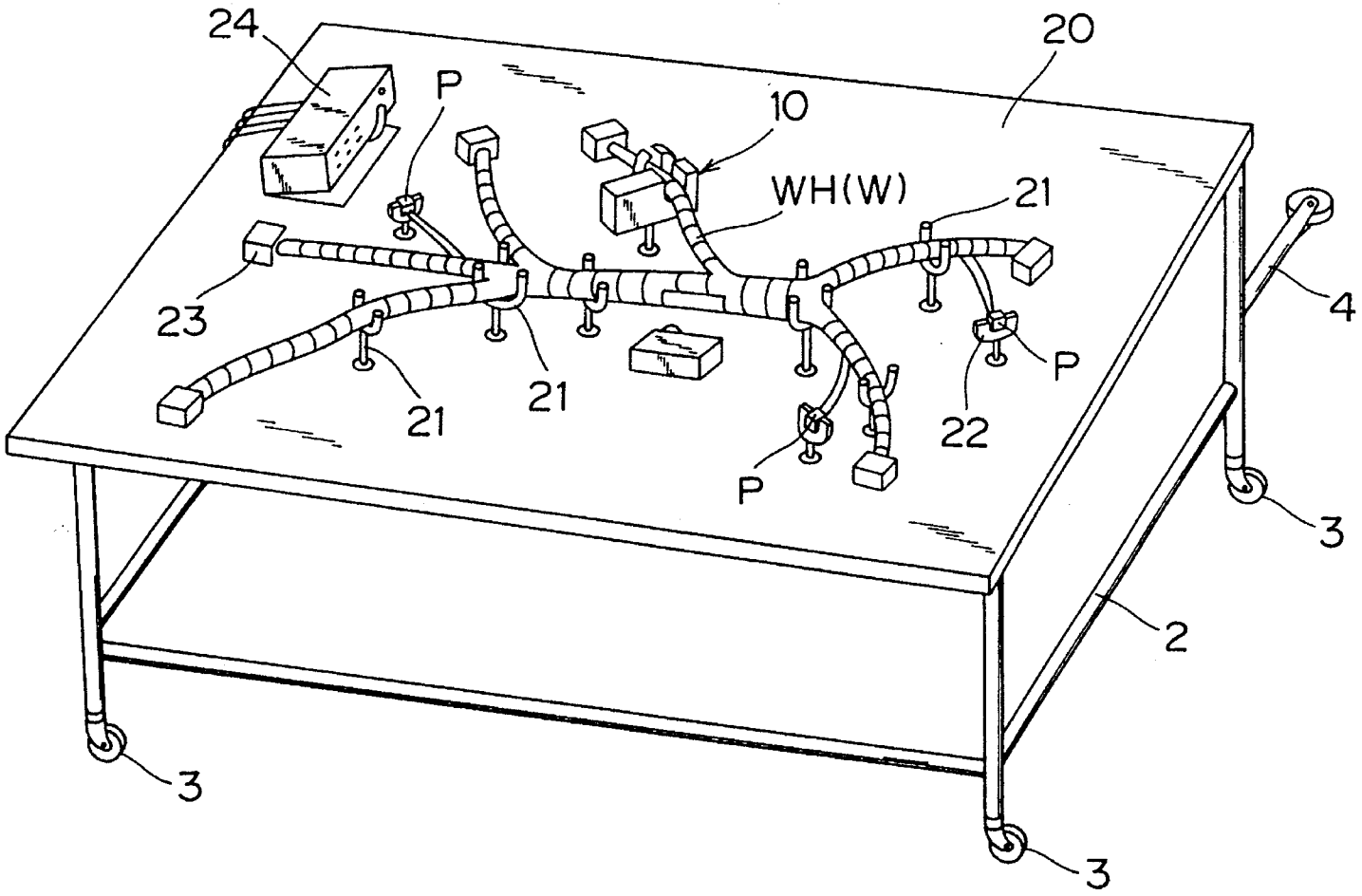
FIG. 1 is a schematic perspective view of a wire harness producing system using a wire harness holding device according to an embodiment of the present invention.

Referring to FIG. 3 to FIG. 8, a holding device 10 according to an embodiment of the present invention comprises a base portion 11, a main body 12 supported by the base portion 11, a drive unit 13 housed in the main body 12, and a cover 14 secured to the main body 12 for covering the drive unit 13.

Figure 3:
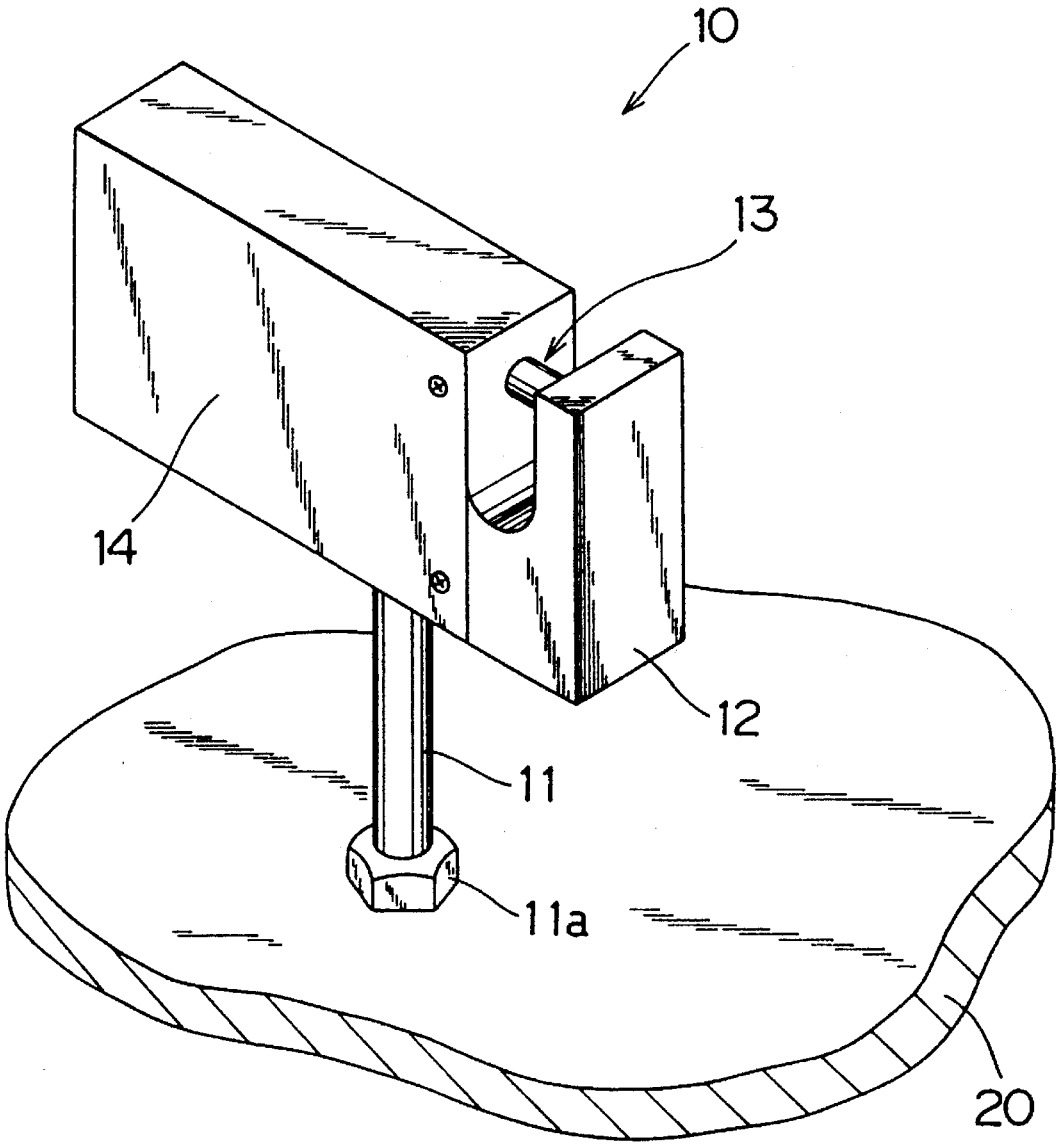
FIG. 3 is a perspective view of the external appearance of the holding device.

As best shown in FIG. 3, the base portion 11 is formed by a shaft made of a steel material of which tip portion is threaded. The base portion 11 is fixed to a drawing plate 20 by a nut 11*a*.

Figure 4:
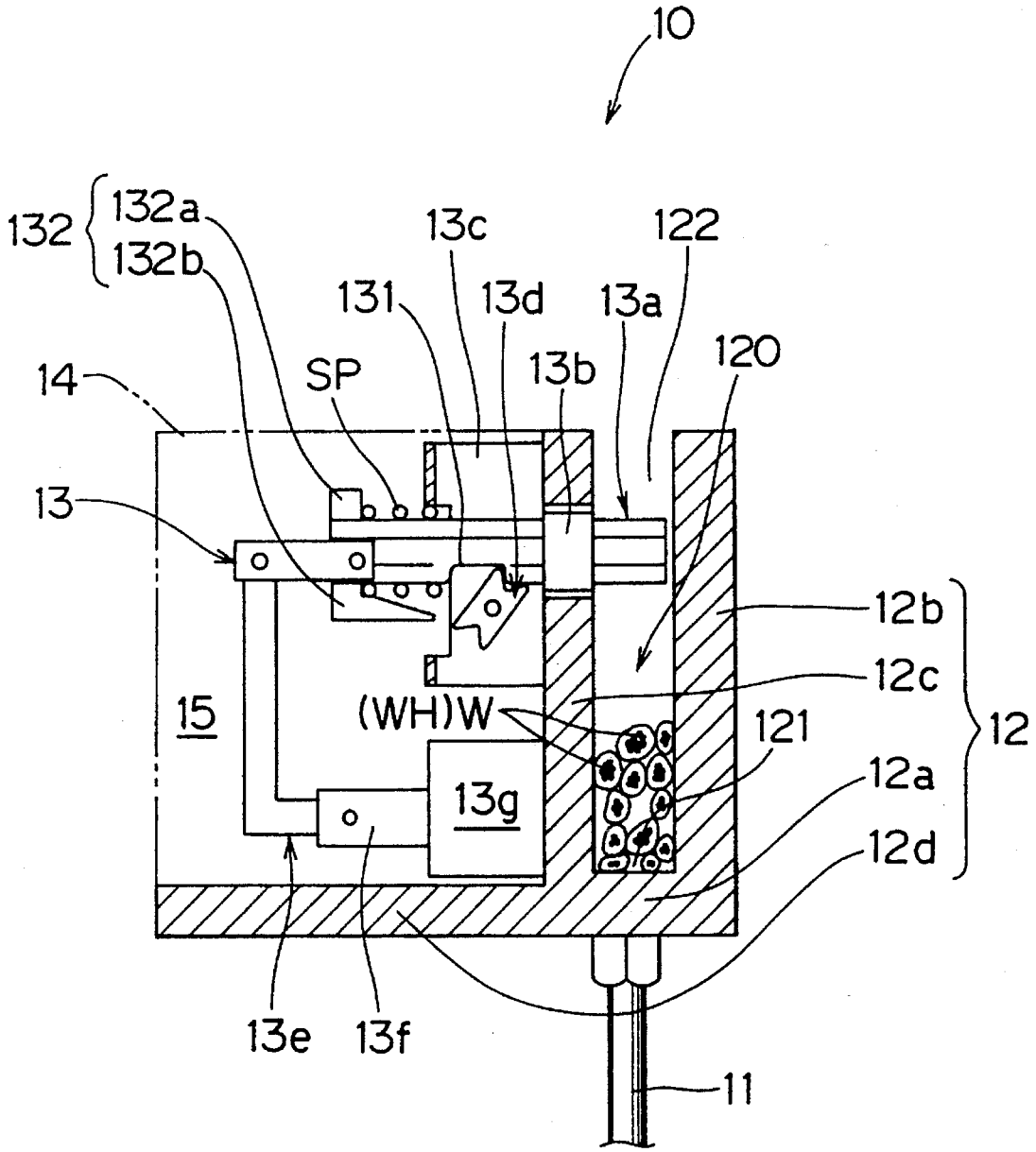
FIG. 4 is a schematic section view of the main portion of the holding device.
Figure 5:
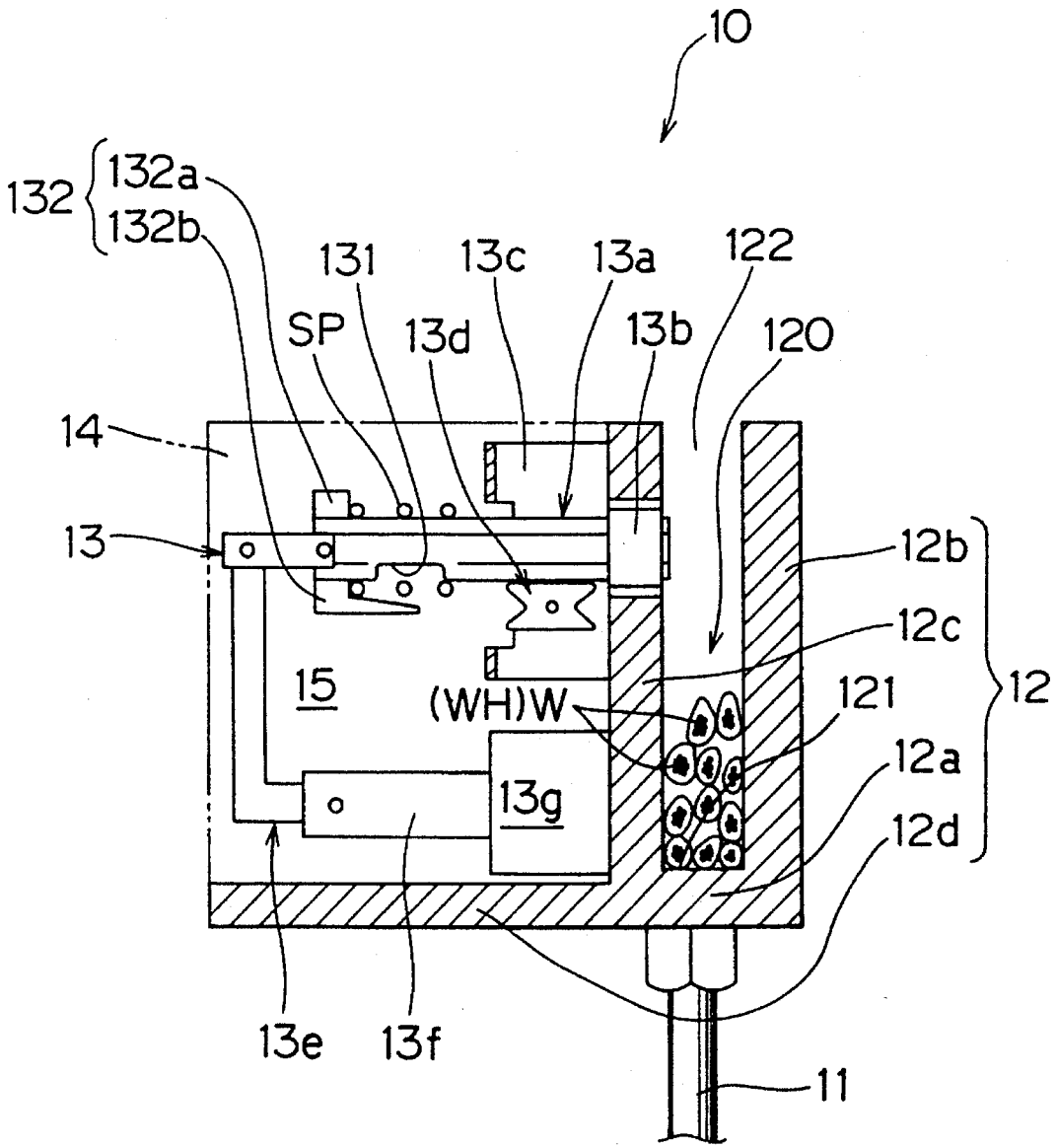
FIG. 5 is a schematic section view of the main portion of the holding device illustrating the operation thereof.

As best shown in FIGS. 4 and 5, the main body 12 is made of resin. Main body 12 has, in a unitary structure, a bottom portion 12*a* secured to the upper end of the base portion 11, a first standing portion 12*b* upwardly extending from one end of the bottom portion 12*a*, and a second standing portion 12*c* upwardly extending from the other end of the bottom portion 12*a*, the second standing portion 12*c* being parallel with the first standing portion 12*b*. The main body 12 may be made of a metallic material.

The first and second standing portions 12*b*, 12*c* form an electric wire holding portion 120 having a substantially U-shape section of which the top is opened. The electric wire holding portion 120 is formed for holding a predetermined portion of a wire harness WH, and has a receiving portion 121 for receiving the bundle of electric wires W of the wire harness WH, and an opening 122 continuous from the receiving portion 121 and communicating with the outside. The bundle of electric wires W refers to a large number of electric wires which are cut by a predetermined length and which are bundled by a tape or the like.

An extending portion 12*d* horizontally extends from the other end of the bottom portion 12*a*. When the rectangular cover 14 is attached to the extending portion 12*d* and the second standing portion 12*c*, there is formed a mechanism chamber 15 in which the drive unit 13 is housed.

The drive unit 13 has a rod 13*a* serving as an opening/closing member. This rod 13*a* has a hexagonal section, and is supported by a holder 13*b* passing through the second standing portion 12*c*. With the rod 13*a* guided by the holder 13*b*, the tip portion of the rod 13*a* is adapted to go in and out the opening 122 in the electric wire holding portion 120, such that the rod 13*a* is displaceable between a surrounding position shown in FIG. 4 and a release position shown in FIG. 5.

A case 13*c* for covering the periphery of the rod 13*a* is fixed to the back side of the second standing portion 12*c* (to the side opposite to the first standing portion 12*b*), and a cam 13*d* for locking the advancing/retreating movement of the rod 13*a* is mounted on the case 13*c*. Formed in the middle course of the rod 13*a* is a notch groove 131, with and from which the cam 13*d* is adapted to be engaged and disengaged.

Secured to the base end of the rod 13*a* is an operating lever 132 for operating the engagement/disengagement of the cam 13*d*. The operating lever 132 has, in a unitary structure, a base 132*a* projecting at a right angle to the rod 13*a* and a lever portion 132*b* which is disposed at one end of the base 132*a* (the lower end of the base 132*a* in FIGS. 4 and 5) and which extends toward the tip of the rod 13*a* along the rod 13*a*.

A compression coiled spring SP is disposed between the base 132*a* and the back side of the case 13*c* for normally biasing the rod 13*a* toward the release position.

Further, the base end portion of the rod 13*a* is connected to a solenoid rod 13*f* through a link arm 13*e*. The solenoid rod 13*f* is adapted to be advanced/retreated by an electromagnetic solenoid 13*g* secured to the back side of the second standing portion 12*c*.

The following description will discuss the operation of the holding device 10 having the arrangement above-mentioned.

In a state where the rod 13*a* is so located as to open the electric wire holding portion 120 as shown in FIG. 5, when the electromagnetic solenoid 13*g* is energized, the solenoid rod 13*f* is driven toward the second standing portion 12*c* (toward the right hand in FIG. 5). Accordingly, the solenoid rod 13*f* drives the rod 13*a* toward the second standing portion 12*c* through the link arm 13*e*. This causes the rod 13*a* to pass through the second standing portion 12*c* against the biasing force of the compression coiled spring SP, thereby to close the opening 122 in the electric wire holding portion 120. At this time, the cam 13*d* is engaged with the notch groove 131 in the rod 13*a* to prevent the rod 13*a* from being moved toward the release position. This causes the rod 13*a* to be locked and displaced in the surrounding position shown in FIG. 4. Accordingly, the rod 13*a* surrounds, together with the electric wire holding portion 120, the bundle of electric wires W of the wire harness WH, thereby to hold the bundle of electric wires W on the drawing plate 20 (See FIG. 1).

Since the rod 13*a* is locked by the cam 13*d*, the rod 13*a* is never returned to the retreat position by the biasing force of the compression coiled spring SP even though the energization of the electromagnetic solenoid 13*g* is stopped.

On the other hand, when the electromagnetic solenoid 13*g* is again energized from the state shown in FIG. 4, the rod 13*a* is displaced, even slightly, from the state shown in FIG. 4 in such a direction as to further pass through the second standing portion 12*c*. As a result, the operating lever 132 rotates the cam 13*d*, causing the cam 13*d* to be disengaged from the notch groove 131. Accordingly, the rod 13*a* becomes free and is driven to the retreat position by the biasing force of the compression coiled spring SP. Thus, the rod 13*a* opens the Opening 122 in the electric wire holding portion 120. This causes the receiving portion 121 of the electric wire holding portion 120 to communicate with the outside through the opening 122, thus releasing the bundle of electric wires W.

As discussed above, the holding device 10 of this embodiment is arranged such that the electric wire holding portion 120 surrounds the wire harness WH together with the rod 13*a* and that the wire harness WH holding state is maintained unless the electromagnetic solenoid 13*g* drives the rod 13*a* again. Accordingly, even though U-shape jigs are used on the drawing plate 20, the wire harness WH is advantageously prevented from unduly coming off from jigs 21 (See FIG. 1).

Further, even after the energization of the electromagnetic solenoid 13*g* is stopped, the rod 13*a* can be maintained at the surrounding position by the lock mechanism (the notch groove 131 and the cam 13*d*). Accordingly, when the electromagnetic solenoid 13*g* is used as the drive unit 13, the electromagnetic solenoid 13*g* needs not to be energized for a long period of time. This advantageously prevents seizing or the like.

A modification of this embodiment may be arranged such that, when energized, the electromagnetic solenoid 13*g* moves the rod 13*a* to the release position. In such a modification, provision is made such that the cam 13*d* is engaged with the notch groove 131 in the rod 13*a* when the rod 13*a* is driven from the surrounding position to the release position. Also, in such a modification, the compression coiled spring SP is so arranged as to normally bias the rod 13*a* to the surrounding position, and the operating lever 132 is adapted such that the cam 13*d* is disengaged from the notch groove 131 when the rod 13*a* at the release position is driven again. The modification can also produce effects similar to those produced in the embodiment above-mentioned.

The holding device 10 having the arrangement above-mentioned can be utilized in various manners in the production line of wire harness WH.

In a wire harness WH assembling process, the holding device 10 can be used in the following production line.

Figure 2:
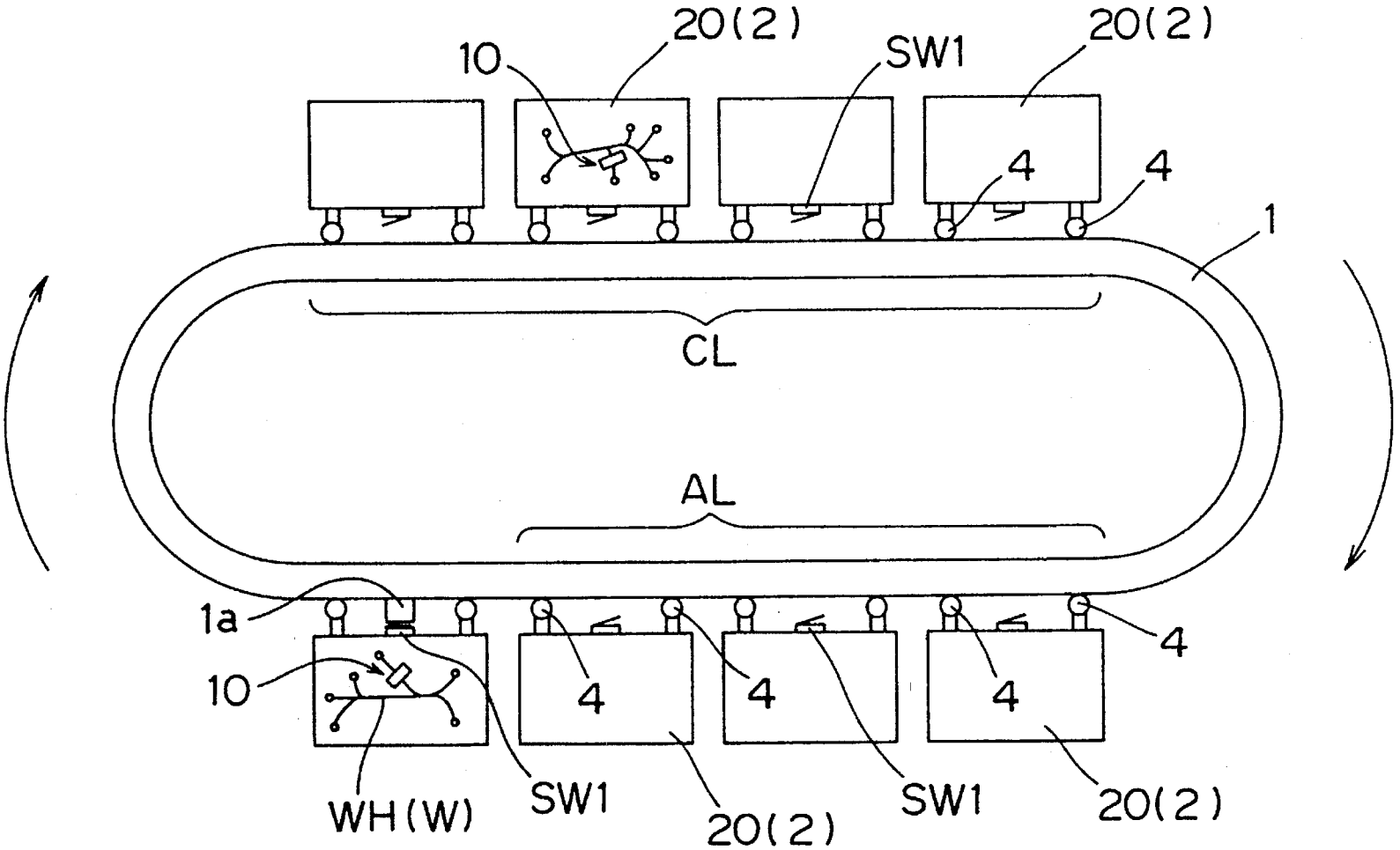
FIG. 2 is a schematic plan view of the producing system shown in FIG. 1.

Referring to FIGS. 1 and 2, the production line is employed in an endless conveyor system 1. This conveyor 1 has a large number of moving tables 2 adapted to be successively moved per process. In FIG. 2, the moving tables 2 are conveyed clockwise. In this production line, there is formed, at an upstream side, a harness assembling line AL for binding a bundle of electric wires W to form a wire harness WH. At a downstream side, there is formed a parts connecting line CL for attaching externally mounted parts P to a wire harness WH assembled at the harness assembling line AL. Specific examples of the externally mounted parts P include connectors, clamps, protectors, corrugate tubes, grommets and the like. Externally mounted parts P are suitably connected to predetermined positions of bundles of electric wires W according to the types of wire harnesses WH to be produced.

As best shown in FIG. 1, each moving table 2 is a metallic frame body formed by combining pipes, angle materials and the like. The frame body is movably supported by casters 3. The frame body forming a moving table 2 is provided at a lateral side thereof with guide roller mechanisms 4 to be connected to the conveyor 1.

To produce a wire harness WH in the harness assembling line AL, a drawing plate 20 is secured to a moving table 2. The drawing plate 20 is fixed to the moving table 2 such that the drawing plate 20 is gently inclined downwardly at this side.

Drawn on the drawing plate 20 is an assembling drawing corresponding to the final form of a wire harness WH. This assembling drawing shows the types and attaching positions of externally mounted parts P.

Further disposed on the drawing plate 20 are jigs 21 for holding a bundle of electric wires W of a wire harness WH, detecting jigs 22 for detecting externally mounted parts P to supply detection signals, and a controller 24 for displaying the connection of each externally mounted part P based on the output signal of each detecting jig 22.

The base portion 11 of the holding device 10 according to the embodiment above-mentioned, is placed as standing at such a position as to hold, together with other jigs 21, an intermediate portion of a bundle of electric wires W provided, at the ends thereof, with externally mounted parts P. This enables a single holding device 10 to prevent the entire wire harness WH from coming off.

Figure 6:
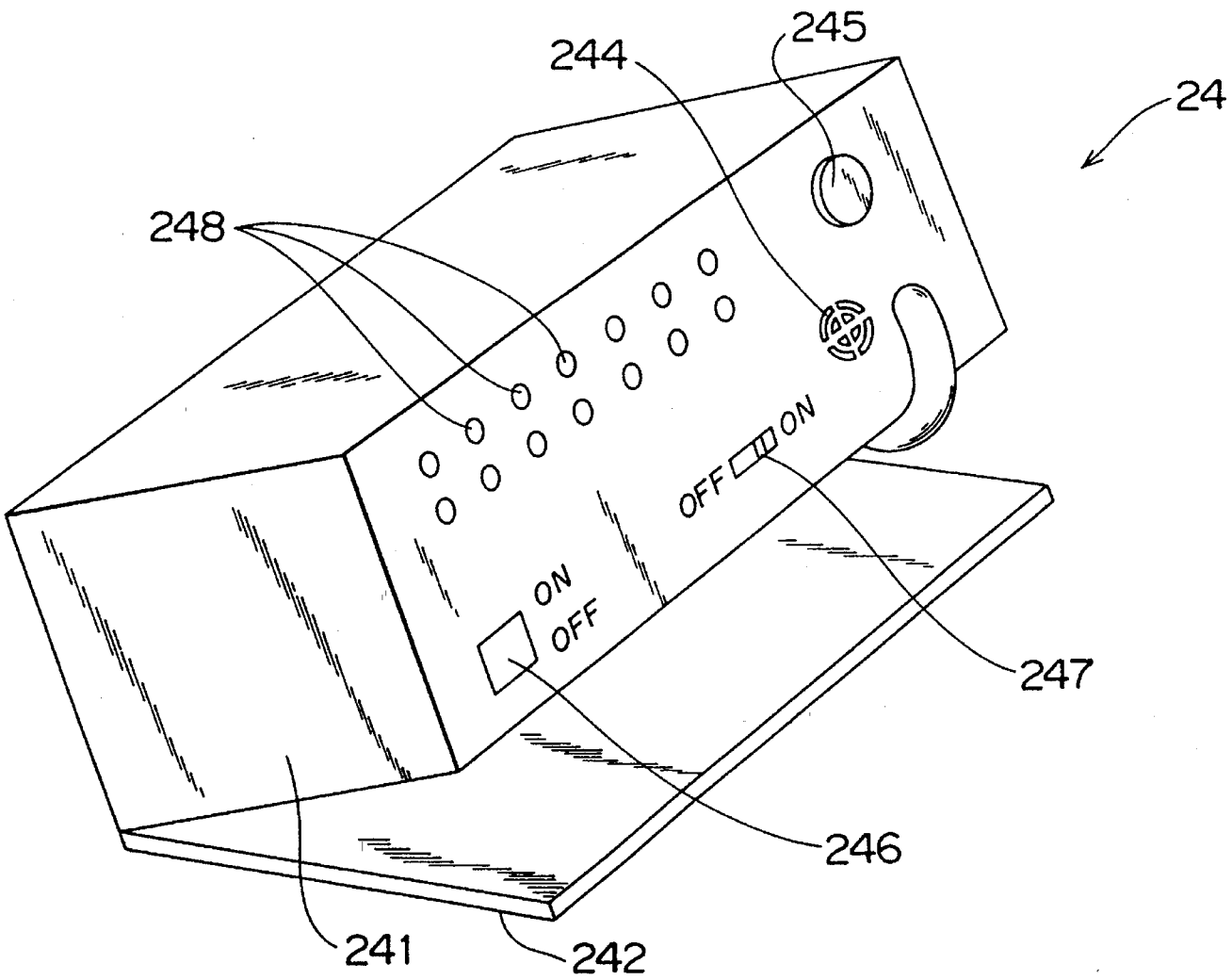
FIG. 6 is a perspective view of the external appearance of a controller used in the holding mechanism.

As best shown in FIG. 6, the controller 24 has, in a unitary structure, a rectangular case body 241 and a placing plate 242 for supporting the case body 241. The case body 241 incorporates a microcomputer 243 (See FIG. 7) and other electric parts. The case body 241 is provided on the front side thereof with an acceptance buzzer 244 and a pilot lamp 245 which serve as informing means for informing the operator of the process completion. There are also disposed a power switch 246, a buzzer switch 247 for switching the necessity of an operation of the acceptance buzzer 244, and display lamps 248 for displaying the part detecting jigs 22 and the conduction inspecting devices 23 which have transmitted detection signals to the microcomputer 243.

Figure 7:
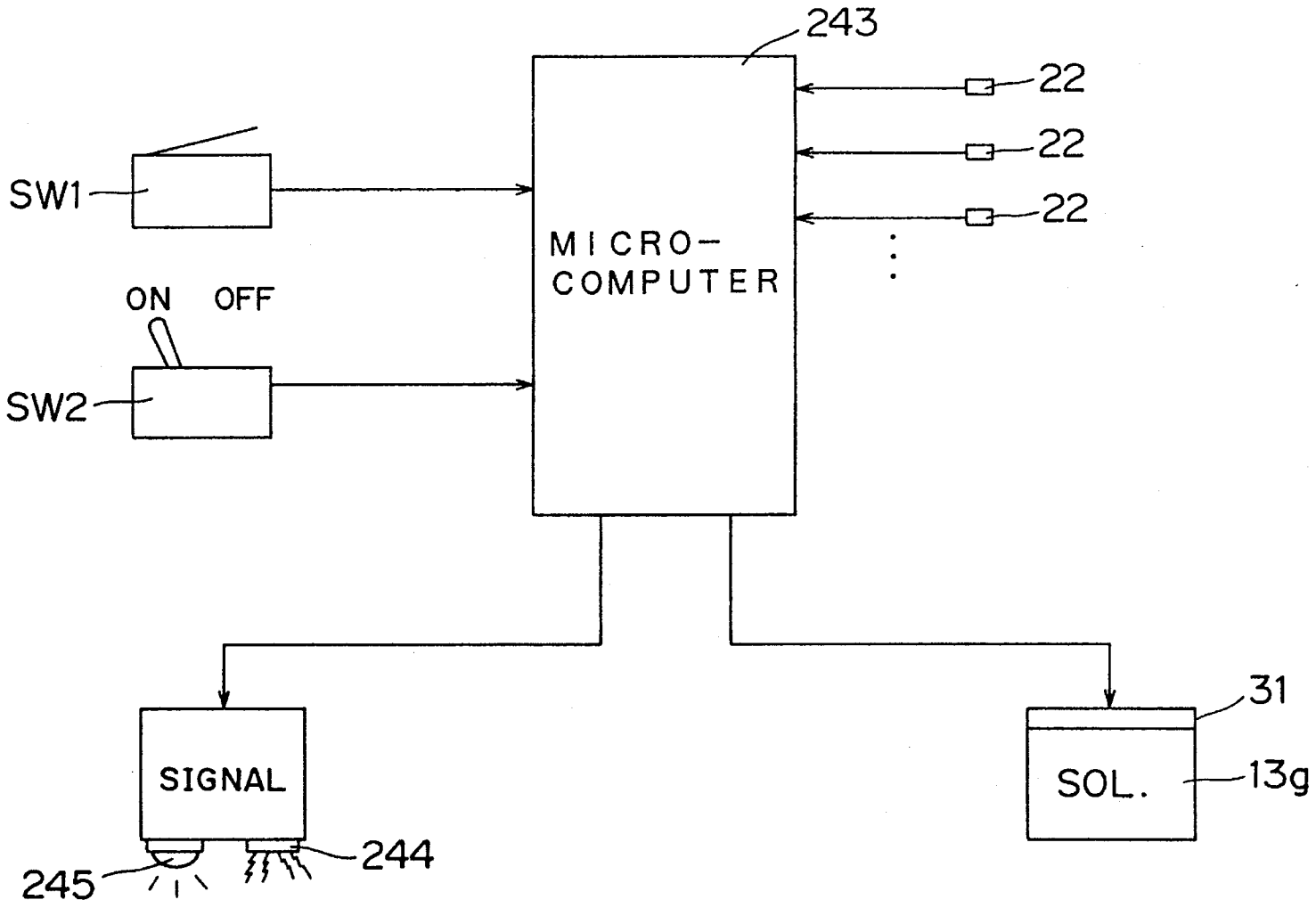
FIG. 7 is a block diagram of the arrangement of the wire harness holding mechanism used with the drawing plate.

As best shown in FIG. 7, the microcomputer 243 is electrically connected to the part detecting jigs 22 shown in FIG. 1. Further, the microcomputer 243 is connected to a limit switch SW1 secured to each working table 2 (See FIGS. 1 and 2). As shown in FIG. 2, the limit switch SW1 is adapted such that its contact is connected by a surrounding switch actuating member 1*a* disposed at the conveyor 1.

The surrounding switch actuating member 1*a* is disposed at a passage point between the downstream side of the harness assembling line AL and the upstream side of the parts connecting line CL.

In this embodiment, a manual switch SW2 (shown only in FIG. 7) for forcibly driving the holding device 10 is also connected to the microcomputer 243.

On the other hand, the microcomputer 243 is electrically connected to a relay circuit 31 for controlling the electromagnetic solenoid 13*g* of the holding device 10 shown in FIG. 1.

Figure 8:
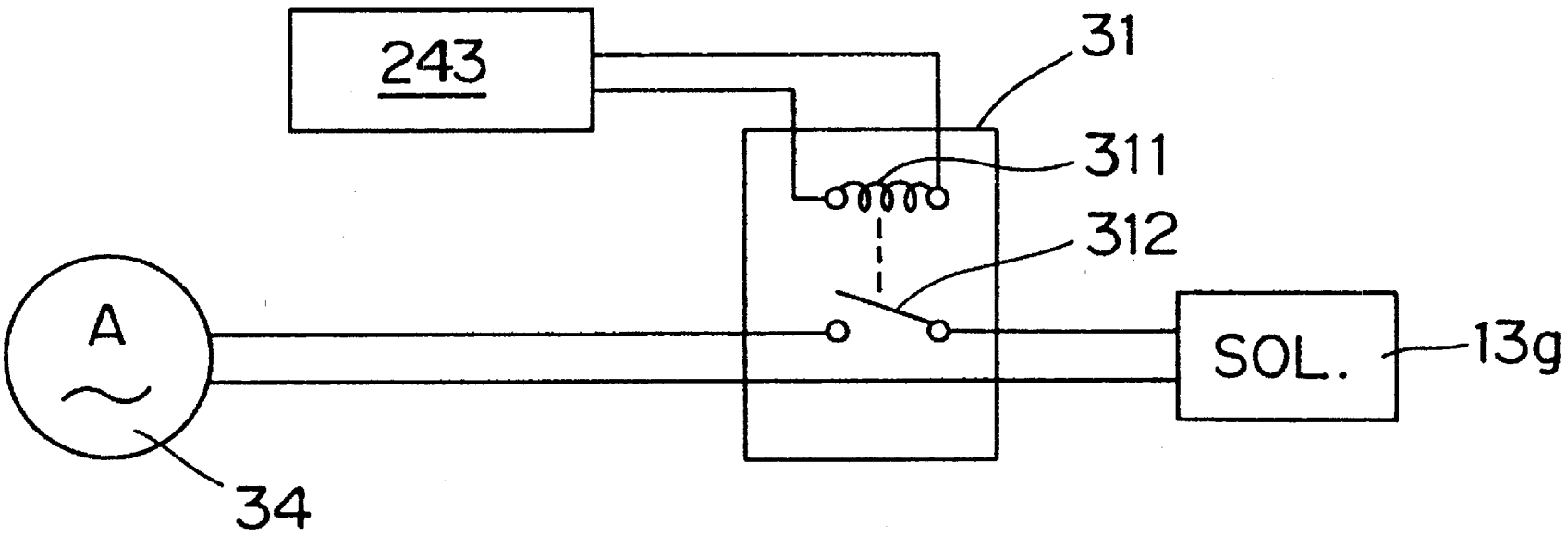
FIG. 8 is a control circuit diagram of a drive unit used in the holding device.

As shown in FIG. 8, the relay circuit 31 has a relay coil 311 to be energized by an output signal of the microcomputer 243, and a power contact 312 for connecting the electromagnetic solenoid 13*g* of the holding device 10 to a power source 34 (for example, an AC voltage 100 v) by the relay coil 311. The relay circuit 31 is adapted to be operated based on an output signal of the microcomputer 243.

The microcomputer 243 incorporates memories such as a ROM, a RAM and the like, timers and the like. The memories contain a first program for supplying a drive signal for driving the electromagnetic solenoid 13*g* of the holding device 10 when the limit switch SW1 or the manual switch SW2 is connected, and a second program for supplying a production process completion signal when all the part detecting jigs 22 have transmitted detection signals.

The drive signal and the production process completion signal are supplied for operating the relay circuit 31 and driving the holding device 10. When the production process completion signal is supplied, this actuates the acceptance buzzer 244 and the pilot lamp 245 which serve as an informing mechanism and which are incorporated in the controller 24.

The following description will discuss a production process to be executed by the production system of this embodiment.

Referring to FIG. 2 showing the production process of this embodiment, when a moving table 2 carrying a drawing plate 20 is moved along the endless conveyor 1 and an operation of housing a bundle of electric wires W at the harness assembling line AL is finished, the surrounding switch actuating member 1*a* attached to the passage point of the endless conveyor 1 is operated to connect the limit switch SW1, causing the first program to be operated.

Then, the microcomputer 243 supplies a drive signal, by which the relay circuit 31 is operated to connect the power source to the electromagnetic solenoid 13*g* . This energizes the electromagnetic solenoid 13*g* to move the rod 13*a* of the holding device 10 to the surrounding position shown in FIG. 4. As a result, the bundle of electric wires W forming a wire harness WH is held by the holding device 10.

At the parts connecting line CL, the externally mounted parts P mentioned earlier are successively attached to the bundle of electric wires W, and the externally mounted parts P thus connected are held by the corresponding part detecting jigs 22. At this time, an external force is exerted to the bundle of electric wires W when each part is attached thereto. However, since the bundle of electric wires W is held by the holding device 10, the wire harness WH can be prevented from unduly coming off the drawing plate 20.

When an externally mounted part P is held by a part detecting jig 22, the part detecting jig 22 transmits a detection signal to the microcomputer 243. As a result, the display lamp 248 corresponding to the part detecting jig 22 which has just transmitted the detection signal, puts out by the control of the microcomputer 243. When all the part detecting jigs 22 have transmitted detection signals, the second program is operated to supply a production process completion signal. Then, the acceptance buzzer 244 and the pilot lamp 245 are operated. This enables the operator to be aware of the completion of the production process.

When the production process completion signal is supplied, the relay circuit 31 is operated again and the electromagnetic solenoid 13*g* is energized to move the rod 13*a* of the holding device 10 to the release position shown in FIG. 5. This causes the wire harness WH to be released from the holding device 10.

As thus discussed, since the holding device 10 is interlocked with the controller 24, the holding state of the wire harness WH by the holding device 10 can be maintained until the production process is complete. This not only prevents the wire harness WH from unduly coming off from the drawing plate 20, but also prevents the wire harness WH with some externally mounted parts P not attached yet thereto, from being erroneously removed from the drawing plate 20.

Further, this embodiment employs the limit switch SW1 and the surrounding switch actuating member 1*a* such that the electromagnetic solenoid 13*g* of the holding device 10 is automatically operated in association with the moving step of the movable drawing plate 20 to switch the wire harness WH holding state. This improves the working efficiency. Further, after the holding device 10 has been switched to the wire harness WH holding state, the wire harness WH can advantageously be prevented from unduly coming off or from being erroneously removed, as a consequence of human factors, from the holding device 10 in the drawing plate 20 moving step.

The holding device 10 of the present invention can also be utilized on a stationary drawing plate. In such a case, the limit switch SW1 discussed in connection with FIGS. 1 and 7 is omitted, and the members and programs relating to this limit switch SW1. With such a stationary drawing plate, a timer may also be used as means for driving the holding device 10 after the actuation of the informing mechanism (the acceptance buzzer 244 and the pilot lamp 245).

Further, the holding device 10 of the embodiment can be utilized merely as a mechanism of preventing a wire harness WH from coming off. In such a case, the relay circuit 31 can be omitted and the manual switch SW2 can be connected directly to a circuit for power supply.

The following description will discuss an application where the holding device 10 of the embodiment is used in an inspection process.

Figure 9:
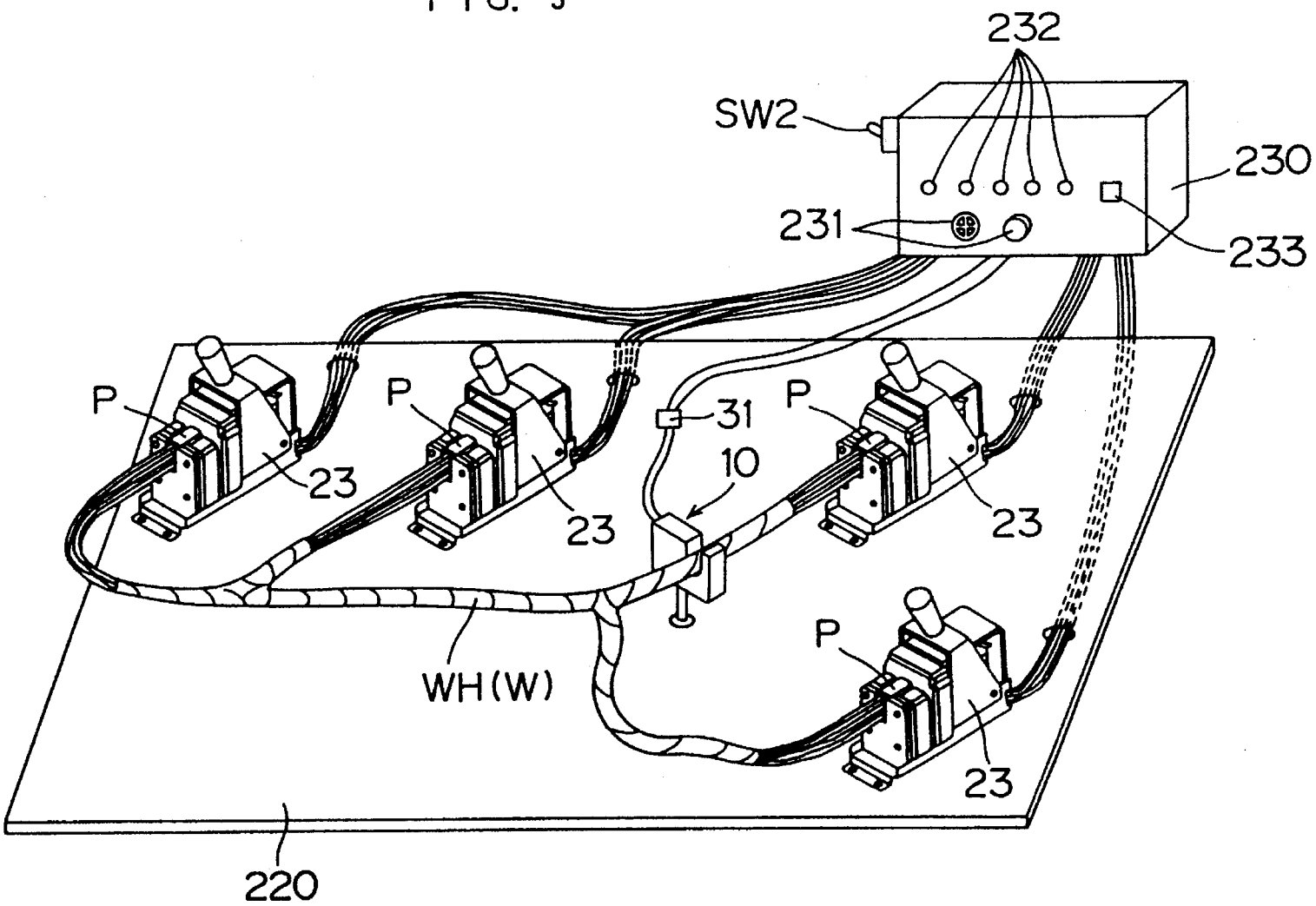
FIG. 9 is a schematic plan view illustrating a wire harness inspection process using the holding device.

Referring to FIG. 9, a wire harness WH for which the production process has been finished, is placed on an inspection drawing plate 220, and electrical conduction tests and the like are to be carried out on the inspection drawing plate 220.

Disposed on the inspection drawing plate 220 are a large number of conduction inspecting devices 23 corresponding to externally mounted parts P (mainly comprising connectors) connected to a bundle of electric wires W. Each of the conduction inspecting devices 23 is adapted to detect the conduction state of the corresponding externally mounted part P and to supply a detection signal to a conduction controller 230 when the conduction state is all right. The conduction controller 230 incorporates an inspection process program for supplying an inspection process completion signal when all the conduction inspecting devices 23 have transmitted detection signals.

The holding device 10 is secured to the inspection drawing plate 220 and electrically connected to the conduction controller 230 as done in the application using the controller 24. The holding device 10 is adapted to be opened by a manual switch SW2 connected to the conduction controller 230. Like the controller 24, the conduction controller 230 has an informing mechanism 231 and display lamps 232. An inspection starting 233 for the conduction inspecting devices 23 is also disposed. In this embodiment, the manual switch SW2 is adapted to be operated following the inspection starting 233. Accordingly, by operating the manual switch SW2, the holding device 10 can be operated without turning the power source to ON/OFF. Further, the operation of the switch contact of the manual switch SW2 is interlocked with the ON/OFF operation of the inspection starting 233, thus enabling the holding device 10 to be automatically driven.

When executing the inspection process, a wire harness WH is first mounted on the inspection drawing plate 220 and the inspection starting 233 of the conduction inspecting devices 23 is turned ON such that the switch contact of the manual switch SW2 is automatically interlocked to drive the rod 13*a* of the holding device 10 to the surrounding position with the wire harness WH mounted on the electric wire holding portion 120 of the holding device 10. Thus, the wire harness WH is held on the inspection drawing plate 220.

When a conduction test is conducted after the wire harness WH has been held by the inspection drawing plate 220, the conduction inspecting devices 23 are adapted to transmit detection signals to the conduction controller 230. The display lamps 232 corresponding to conduction inspecting devices 23 which have transmitted such detection signals, turn off by the control of the conduction controller 230. When all the conduction inspecting devices 23 have transmitted the detection signals, the inspection process program is operated to supply an inspection process completion signal. Likewise in the production process mentioned earlier, the informing mechanism is then operated to inform the operator of the completion of the inspection process.

By the inspection process completion signal, the holding device 10 is again driven to release the bundle of electric wires W of the wire harness WH.

According to the arrangement of this embodiment, a mistake as a consequence of human factors can be prevented in the inspection process likewise in the production process.

The holding device 10 of the present invention can also be applied to a production line where a production process and an inspection process are executed on the same drawing plate. In such a case, the control system of the production line incorporates such a program or is set such that, with the use of the mechanism in FIG. 2 (the limit switch SW1 and the switch actuating member 1*a*), a wire harness WH is held by the holding device 10 in the middle course of the production process and that a process completion signal is supplied to the relay circuit 31 connected to the holding device 10 at the final process of a series of processes.

Thus, it would readily be understood that, even when executing a plurality of processes on the same drawing plate 20, a wire harness WH can be prevented from being unduly removed from the drawing plate 20 as a consequence of human factors before a series of processes are finished.

The embodiments above-mentioned are to be considered as preferred specific examples of the present invention, and the present invention should not be limited to these embodiments. For example, a motor, an air cylinder, a hydraulic cylinder or the like may be used instead of the electromagnetic solenoid 13*g* of the holding device 10. Thus, the present invention may be embodied in other specific forms without departing from the spirit or essential characteristics thereof.

The embodiments above-mentioned are therefore considered in all respects as illustrative for clarifying the technical concept of the present invention, and the present invention is not to be construed in a restricted sense as limited to these specific embodiments. Thus, the spirit and scope of the present invention are limited only by the appended claims.

We claim:

1. A wire harness holding device comprising:

an electric wire holding portion for holding a predetermined portion of a wire harness;

an opening/closing member attached to said electric wire holding portion and movable between a surrounding position where said opening/closing member locks up the wire harness in said electric wire holding portion and a release position where said opening/closing member releases the wire harness from said electric wire holding portion; and a drive unit for driving said opening/closing member to one of said positions at a predetermined time, said drive unit being adapted to drive said opening/closing member such that said opening/closing member is driven to said surrounding position when the wire harness is mounted on said electric wire holding portion in the course of a predetermined process, and such that said opening/closing member, from said surrounding position, is driven to said release position in response to a process completion signal supplied upon completion of the predetermined process.

2. A wire harness holding mechanism where a wire harness holding device of claim 1 is mounted on a movable drawing plate adapted to be moved by one process area per process, said drive unit of said wire harness holding device being adapted to drive said opening/closing member to said surrounding position in association with movement of said movable drawing plate.

3. A wire harness holding device according to claim 1, wherein said drive unit comprises:

an electromagnetic solenoid for driving said opening/closing member to one of said positions;

a locking cam for locking said opening/closing member driven to one of said positions by said electromagnetic solenoid; and a biasing member for biasing said opening/closing member to the other of said positions.

4. A wire harness holding mechanism where a wire harness holding device of claim 3 is mounted on a movable drawing plate adapted to be moved by one process area per process, said drive unit of said wire harness holding device being adapted to drive said opening/closing member to a surrounding position in association with movement of said movable drawing plate.

5. A wire harness holding method for holding a wire harness with a harness holding device including an electric wire holding portion for holding a bundle of electric wires of a wire harness, an opening/closing member attached to said electric wire holding portion and movable between a surrounding position and a release position, and a drive unit for driving said opening/closing member to said positions, said method comprising the steps of:

holding a bundle of electric wires forming a wire harness on a drawing plate with said harness holding device;

causing said drive means to drive said opening/closing member to said surrounding position to lock the bundle of electric wires to said drawing plate to hold the bundle of electric wires to said drawing plate;

carrying out a processing step for executing a predetermined process on the bundle of electric wires held on said drawing plate; and causing said drive means to drive said opening/closing member to said release position to release the bundle of electric wires in response to a process completion signal after the processing step has been finished.

6. A wire harness holding apparatus comprising:

a wire holding device including an electric wire holding portion for holding a predetermined portion of a wire harness, an opening/closing member attached to said electric wire holding portion and movable between a surrounding position where said opening/closing member locks a wire harness in said electric wire holding portion and a release position where said opening/closing member releases the wire harness from said electric wire holding portion, and a drive unit for driving said opening/closing member to one of said positions;

means for detecting completion of assembly processes and providing a signal indicative of detected completion; and means for controlling said drive unit in response to a signal from said detecting means.

7. A wire harness holding apparatus according to claim 6, wherein said control means controls said drive unit to move said opening/closing member to said surrounding position when a wire harness is mounted on said electric wire holding portion and to said release position upon receipt of a signal indicative of detection from said detecting means.

8. A wire harness holding apparatus according to claim 6, wherein said drive unit comprises:

an electromagnetic solenoid for driving said opening/closing member to one of said positions;

a locking cam for locking said opening/closing member driven to one of said surrounding and releasing positions by said electromagnetic solenoid; and a biasing member for biasing said opening/closing member to the other of said positions.

9. A wire harness holding apparatus according to claim 6, further comprising a movable drawing plate adapted to be moved by one process area per process, said wire holding device being mounted to said drawing plate, and wherein said drive unit drives said opening/closing member to said surrounding position in response to a movement of said movable drawing plate.

10. A wire harness holding apparatus according to claim 6, further comprising:

means for inspecting a connection between terminal parts and a wire harness and for providing a signal indicative of a connective condition thereof, and wherein said controlling means is in communication with said detecting means and said inspecting means, and said controlling means also controls said drive unit in response to signals from said connecting means.

* * * * *